US010612797B2

(12) United States Patent
Hashimoto et al.

(10) Patent No.: US 10,612,797 B2
(45) Date of Patent: Apr. 7, 2020

(54) OUTDOOR UNIT FOR AIR CONDITIONER

(71) Applicant: HITACHI-JOHNSON CONTROLS AIR CONDITIONING, INC., Tokyo (JP)

(72) Inventors: Takayuki Hashimoto, Tokyo (JP); Takashi Ooishi, Tokyo (JP); Shin Miura, Tokyo (JP); Rei Kasahara, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 0 days.

(21) Appl. No.: 16/072,273

(22) PCT Filed: Dec. 26, 2016

(86) PCT No.: PCT/JP2016/088635
§ 371 (c)(1),
(2) Date: Jul. 24, 2018

(87) PCT Pub. No.: WO2017/130618
PCT Pub. Date: Aug. 3, 2017

(65) Prior Publication Data

US 2019/0032928 A1 Jan. 31, 2019

(30) Foreign Application Priority Data

Jan. 27, 2016 (JP) ..... 2016-012924

(51) Int. Cl.
*F24F 1/22* (2011.01)
*F24F 11/89* (2018.01)
*F24F 11/88* (2018.01)

(52) U.S. Cl.
CPC ..... *F24F 1/22* (2013.01); *F24F 11/88* (2018.01); *F24F 11/89* (2018.01)

(58) Field of Classification Search
CPC .... F24F 1/22; F24F 11/88; F24F 11/89; F24F 1/20; F25B 49/022; F25B 49/025
See application file for complete search history.

(56) References Cited

U.S. PATENT DOCUMENTS 4,810,943 A * 3/1989 Kawaguchi ..... F25B 49/025 318/375
5,764,022 A * 6/1998 Kazama ..... H02M 5/458 318/801

(Continued)

FOREIGN PATENT DOCUMENTS

CN 101090253 A 12/2007
CN 101395430 A 3/2009

(Continued)

OTHER PUBLICATIONS

Chinese Office Action received in corresponding Chinese Application No. 201680079014.4 dated Jan. 11, 2019.

(Continued)

*Primary Examiner* — Nelson J Nieves
(74) *Attorney, Agent, or Firm* — Mattingly & Malur, PC

(57) ABSTRACT

The present invention provides an outdoor unit for an air conditioner that can be constructed at low cost while reducing risk of malfunction. The outdoor unit has a compressor; a fan motor; a compressor driver board having a compressor inverter circuit and a compressor driver circuit; and a fan driver board having a fan inverter circuit and fan driver circuit. The compressor driver board has at least either: a shared control circuit that feeds a first switching signal for a compressor to the compressor driver circuit and feeds a second switching signal for a fan to the fan driver circuit; or a shared power source circuit that steps down a first DC voltage to a second DC voltage and supplies the second DC voltage to the compressor driver circuit and to the fan driver circuit.

10 Claims, 11 Drawing Sheets

(56) References Cited

U.S. PATENT DOCUMENTS

| | | | | |
|---|---|---|---|---|
| 2008/0266811 | A1* | 10/2008 | Yamada | F24F 1/12 361/720 |
| 2009/0007579 | A1 | 1/2009 | Natsume et al. | |
| 2009/0178424 | A1* | 7/2009 | Hwang | F24F 1/20 62/259.1 |
| 2010/0186441 | A1* | 7/2010 | Lee | F24F 1/20 62/507 |
| 2012/0191253 | A1* | 7/2012 | Rockenfeller | F24F 3/00 700/276 |
| 2012/0214321 | A1 | 8/2012 | Kagimura et al. | |
| 2015/0192337 | A1* | 7/2015 | Choi | F25B 49/025 62/230 |
| 2016/0061506 | A1* | 3/2016 | Song | H02P 6/18 62/216 |
| 2016/0245571 | A1* | 8/2016 | Shinomoto | H02M 1/36 |
| 2016/0329844 | A1* | 11/2016 | Sato | H02P 1/58 |
| 2017/0261199 | A1* | 9/2017 | Horng | H02J 9/065 |
| 2018/0034403 | A1* | 2/2018 | Kim | F24F 13/14 |
| 2018/0091079 | A1* | 3/2018 | Kashima | H02P 21/22 |
| 2018/0175766 | A1* | 6/2018 | Sakai | F25B 13/00 |
| 2018/0198390 | A1* | 7/2018 | Oya | H02K 29/08 |
| 2018/0278049 | A1* | 9/2018 | Sakurai | F24F 11/88 |

FOREIGN PATENT DOCUMENTS

| | | | | | |
|---|---|---|---|---|---|
| JP | 58-107092 | A | | 6/1983 | |
| JP | 06-165588 | A | | 6/1994 | |
| JP | 2003-348892 | A | | 12/2003 | |
| JP | 2009-243800 | A | | 10/2009 | |
| JP | 4816788 | B2 | | 11/2011 | |
| JP | 2012-122645 | A | | 6/2012 | |
| JP | 2012172913 | A | * | 9/2012 | F24F 1/20 |
| KR | 2001-0088563 | A | | 9/2001 | |
| KR | 2004-0030241 | A | | 4/2004 | |
| KR | 2004-0105263 | A | | 12/2004 | |
| KR | 2011-0079032 | A | | 7/2011 | |

OTHER PUBLICATIONS

International Search Report and Written Opinion of PCT/JP2016/088635 dated Mar. 21, 2017.

Extended European Search Report received in corresponding European Application No. 16888202.5 dated Sep. 18, 2019.

* cited by examiner

OUTDOOR UNIT FOR AIR CONDITIONER

TECHNICAL FIELD

The present invention relates to an outdoor unit for an air conditioner.

BACKGROUND ART

An air conditioner, in which refrigerant is circulated to perform a vapor-compression refrigeration cycle, includes an electric circuit such as an inverter circuit for controlling operations of a compressor and a propeller fan. In general, an inverter circuit of air conditioners is implemented on a printed circuit board. As an example of such a printed circuit board, Patent Literature 1 listed below states in paragraph 0058 that "The electronic components (4, 5, 6, 7) provided on the printed circuit board (2) are a central processing unit (CPU) (4), a transformer (5), capacitors (6), and connectors (7) for other devices. Each of terminal pins (3a) of the power module (3) upwardly extends (extends toward a near side relative to the plane of the figure) so as to penetrate the printed circuit board (2)".

PRIOR ART DOCUMENT

Patent Literature

Patent Literature 1: Japanese Patent No. 4816788

SUMMARY OF THE INVENTION

Problems to be Solved by the Invention

Patent Literature 1 does not describe voltages applied to the parts in detail. In general, however, insulated gate bipolar transistors (IGBTs) serving as switching elements of the power module are driven with a voltage of 15 V for example, and a control circuit including a microcomputer is driven with a voltage of 5 V for example. If n compressors and m propeller fans are each provided with the inverter circuit of the Patent Literature 1, the inverter circuit boards for the n compressors and the inverter circuit boards for the m propeller fans are each provided with a 5 V power source circuit and a 15 V power source circuit. Accordingly, (n+m) 5 V power source circuits and (n+m) 15 V power source circuits are provided for these inverter circuits, and (n+m) control circuits are provided as well. As an increased number of power source circuits and control circuits are provided in accordance with the number of compressors and propeller fans, the cost of the inverter circuits increases. On the other hand, merely aggregating those circuits increases a risk of malfunction due to influences of noises. The present invention has been made in view of the situations described above, and an object thereof is to provide an outdoor unit for an air conditioner that can be constructed at low cost while reducing risk of malfunction.

Solution to Problem

To solve the above-described problem, an outdoor unit for an air conditioner according to the present invention includes: a compressor that compresses refrigerant; a heat exchanger that transfers heat between the refrigerant and outdoor air; a fan motor that drives a fan for blowing air to the heat exchanger; a compressor driver board including a compressor inverter circuit having a plurality of first switching elements used for generating an AC voltage from a first DC voltage to drive the compressor as well as a compressor driver circuit that amplifies a first switching signal for the compressor and feeds the amplified first switching signal to the plurality of first switching elements; and a fan driver board including a fan inverter circuit having a plurality of second switching elements used for generating an AC voltage from the first DC voltage to drive the fan motor as well as a fan driver circuit that amplifies a second switching signal for the fan and feeds the amplified second switching signal to the second plurality of switching elements. The compressor driver board further has at least either: a shared control circuit that feeds the first switching signal to the compressor driver circuit and feeds the second switching signal to the fan driver circuit; or a shared power source circuit that steps down the first DC voltage to a second DC voltage and supplies the second DC voltage to the compressor driver circuit and to the fan driver circuit.

Effects of the Invention

According to the present invention, an outdoor unit for an air conditioner can be constructed at low cost while reducing risk of malfunction.

EMBODIMENTS FOR CARRYING OUT THE INVENTION

First Embodiment

Appearance Configuration

Figure 1:
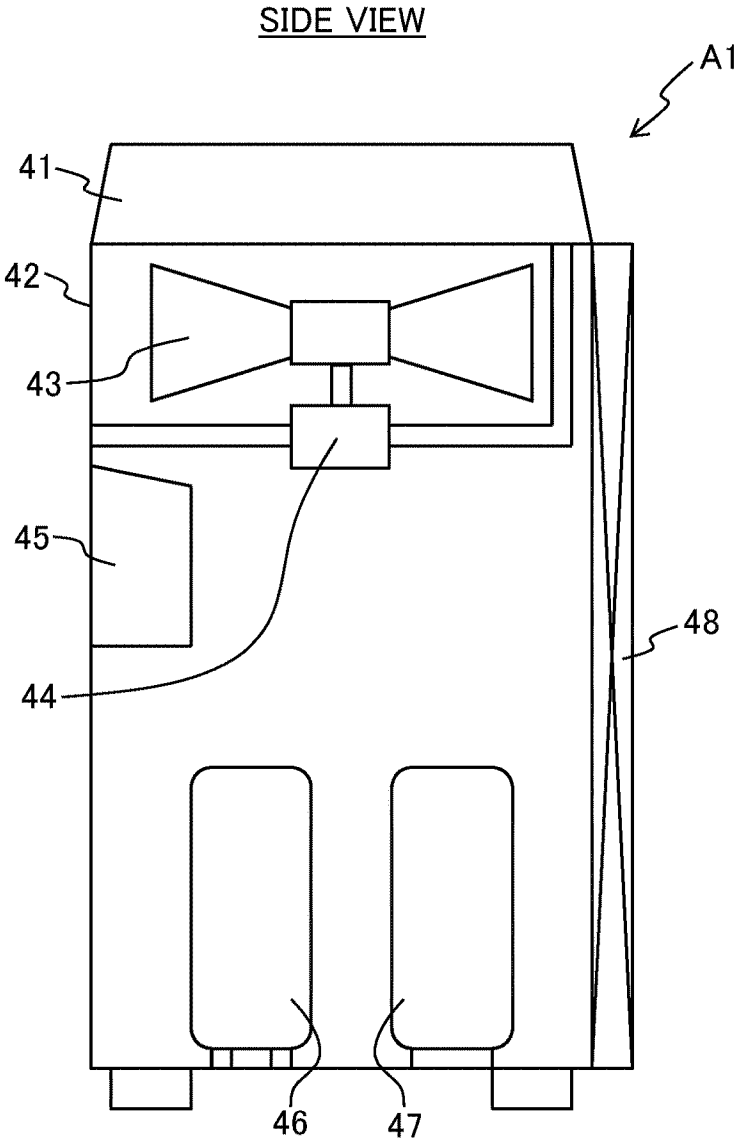
FIG. 1 is a side view of an outdoor unit for an air conditioner according to a first embodiment of the present invention.

Hereinafter, a description will be given of an air conditioner according to a first embodiment of the present invention with reference to the accompanying drawings. FIG. 1 is a side view of an outdoor unit A1 of an air conditioner according to the present embodiment. A cover (not shown) or a door (not shown) is attached to each side of the outdoor unit A1. FIG. 1 shows the outdoor unit A1 in a state in which covers and doors are removed.

As shown in FIG. 1, the outdoor unit A1 has a fan guard 41, a propeller fan 43, a fan motor 44, an electric parts box 45, a compressor 46, an accumulator 47, and a heat exchanger 48. The left end of FIG. 1 corresponds to a front face 42 of the outdoor unit A1. The front face 42 has an opening for maintenance. The compressor 46 sucks and compresses refrigerant and discharges the compressed refrigerant. The compressor 46 may be selected from various compressors such as a scroll compressor. The compressor 46 internally has a motor and a compression mechanism driven by the motor (each not shown). The motor in the compressor 46 and the fan motor 44 are each a permanent magnet synchronous motor.

The heat exchanger 48 is an air heat exchanger for exchanging heat between the refrigerant and outdoor air, and may be selected from cross-fin type fin-and-tube heat exchangers or the like. The fan motor 44 rotationally drives the propeller fan 43 to discharge air in a case of the outdoor unit A1 upward, and to thereby cause the outdoor air to pass through the heat exchanger 48. The accumulator 47 separates incoming refrigerant into gas and liquid and transfers the separated gas refrigerant to the compressor 46. The fan guard 41 is formed in a mesh shape to prevent foreign matters from entering from above into the outdoor unit A1. In the electric parts box 45, a driver circuit for the compressor 46, a driver circuit for the propeller fan 43, and other various electric parts are mounted.

Figure 2:
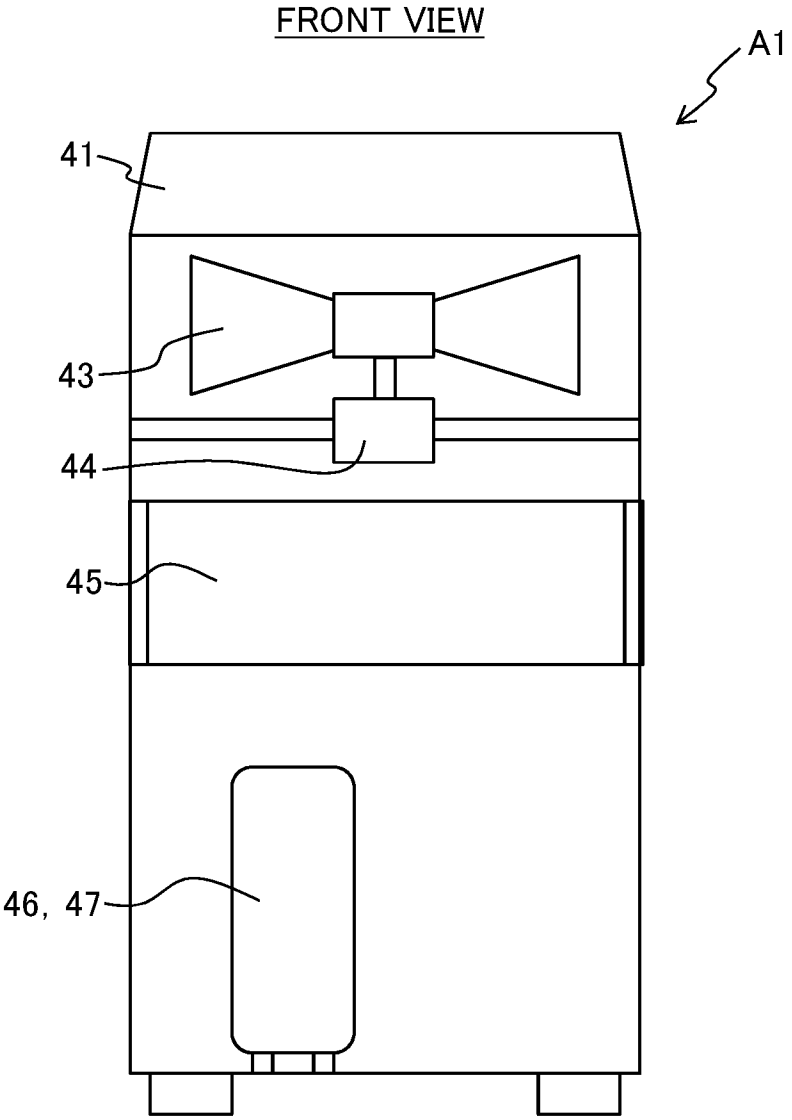
FIG. 2 is a front view of the outdoor unit.

FIG. 2 is a front view of the outdoor unit A1. As shown in FIG. 2, opening a door (not shown) for maintenance located on the front side of the outdoor unit A1 reveals the electric parts box 45 on the front side.

Electrical Configuration

Next, a description will be given of the electrical configuration of the present embodiment with reference to the block diagram shown in FIG. 3.

Figure 3:
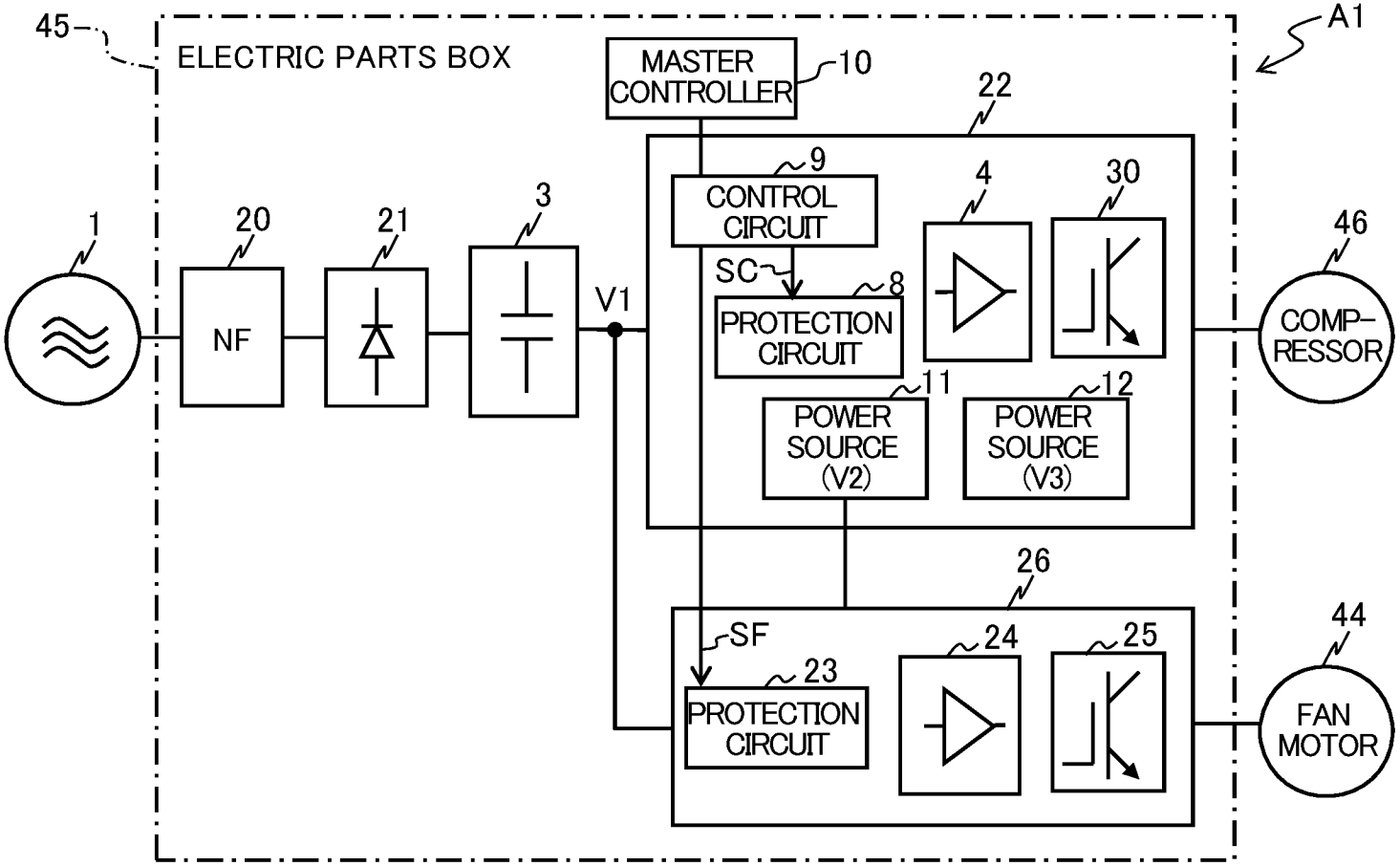
FIG. 3 is a block diagram of the outdoor unit.

In FIG. 3, a three-phase AC power source 1 is a commercial power source, for example. A noise filter 20 attenuates noise components of the voltage or current supplied from the AC power source 1. A diode bridge 21 converts an inputted AC voltage to a DC voltage. A smoothing capacitor 3 smoothes this DC voltage.

When, for example, a voltage RMS value of the AC power source 1 is 200 V, a DC voltage V1 provided by the smoothing capacitor 3 is approximately 280 V. This DC voltage V1 is supplied to a compressor driver board 22 and a fan driver board 26. A master controller 10 communicates with an indoor unit not shown, and, on the basis of an operation mode (cooling, heating, dehumidifying and the like), a temperature setting, and an ambient temperature, determines operational conditions such as a rotation speed of the compressor 46 and a rotation speed of the fan motor 44, and commands a control circuit 9 in the compressor driver board 22 so as to satisfy the operational conditions.

In the compressor driver board 22, a power source circuit 11 (shared power source circuit) steps down a DC voltage V1 to generate a DC voltage V2 (e.g., 15 V), and a power source circuit 12 further steps down the DC voltage V2 to generate a DC voltage V3 (e.g., 5 V). A compressor inverter circuit 30 has insulated gate bipolar transistors (IGBTs) serving as switching elements as well as diodes, and modulates the DC voltage V1 with pulse width modulation (PWM) by the IGBTs to generate an AC voltage for driving the compressor 46.

The control circuit 9 (shared control circuit) is provided with a general computer made up of hardware parts, such as a central processing unit (CPU), a random access memory (RAM) and a read only memory (ROM). The ROM stores a control program to be executed by the CPU as well as various kinds of data and the like. The control circuit 9 outputs, by the control program, a PWM signal SC with which the compressor inverter circuit 30 performs PWM.

The control circuit 9 operates with the DC voltage V3 (5 V). With this voltage, however, it is difficult to directly drive the IGBTs. For this reason, a compressor driver circuit 4 operates with the DC voltage V2 (15 V) and amplifies the PWM signal SC and applies the amplified PWM signal SC to each IGBT in the compressor inverter circuit 30. The DC voltage V2 is also supplied to a compressor protection circuit 8. The compressor protection circuit 8 protects the compressor inverter circuit 30 in the event of abnormality such as excess current or voltage.

Figure 4:
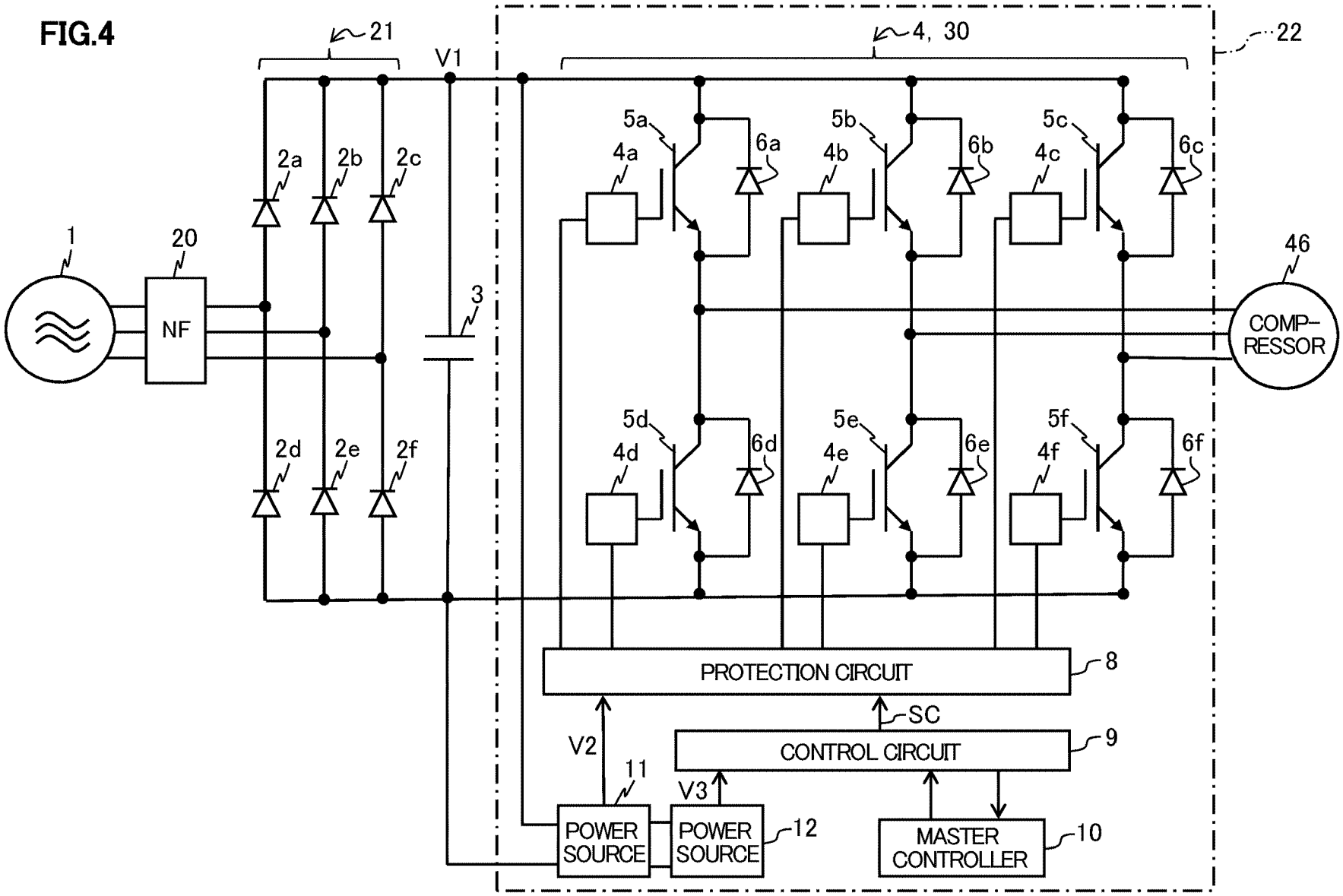
FIG. 4 is a circuit diagram of main components of the outdoor unit.

Next, with reference to the circuit diagram shown in FIG. 4, main components of the compressor driver board 22 will be described.

A diode bridge 21 has six bridge-connected diodes 2*a* to 2*f*. The compressor inverter circuit 30 has six bridge-connected IGBTs 5*a* to 5*f* and free-wheeling diodes 6*a* to 6*f* connected thereto in parallel. The compressor driver circuit 4 has voltage amplifiers 4*a* to 4*f* respectively connected to gate terminals of the IGBTs 5*a* to 5*f*. The PWM signal SC fed from the control circuit 9 to the compressor driver circuit 4 practically passes through the compressor protection circuit 8 as shown in the figure. With this structure, if the control circuit 9 malfunctions to output an improper PWM signal SC, the compressor protection circuit 8 blocks the PWM signal SC to protect the compressor inverter circuit 30.

Returning to FIG. 3, the fan driver board 26 includes a fan protection circuit 23, a fan driver circuit 24 and a fan inverter circuit 25. The fan driver board 26 will be described in detail with reference to FIG. 5.

Figure 5:
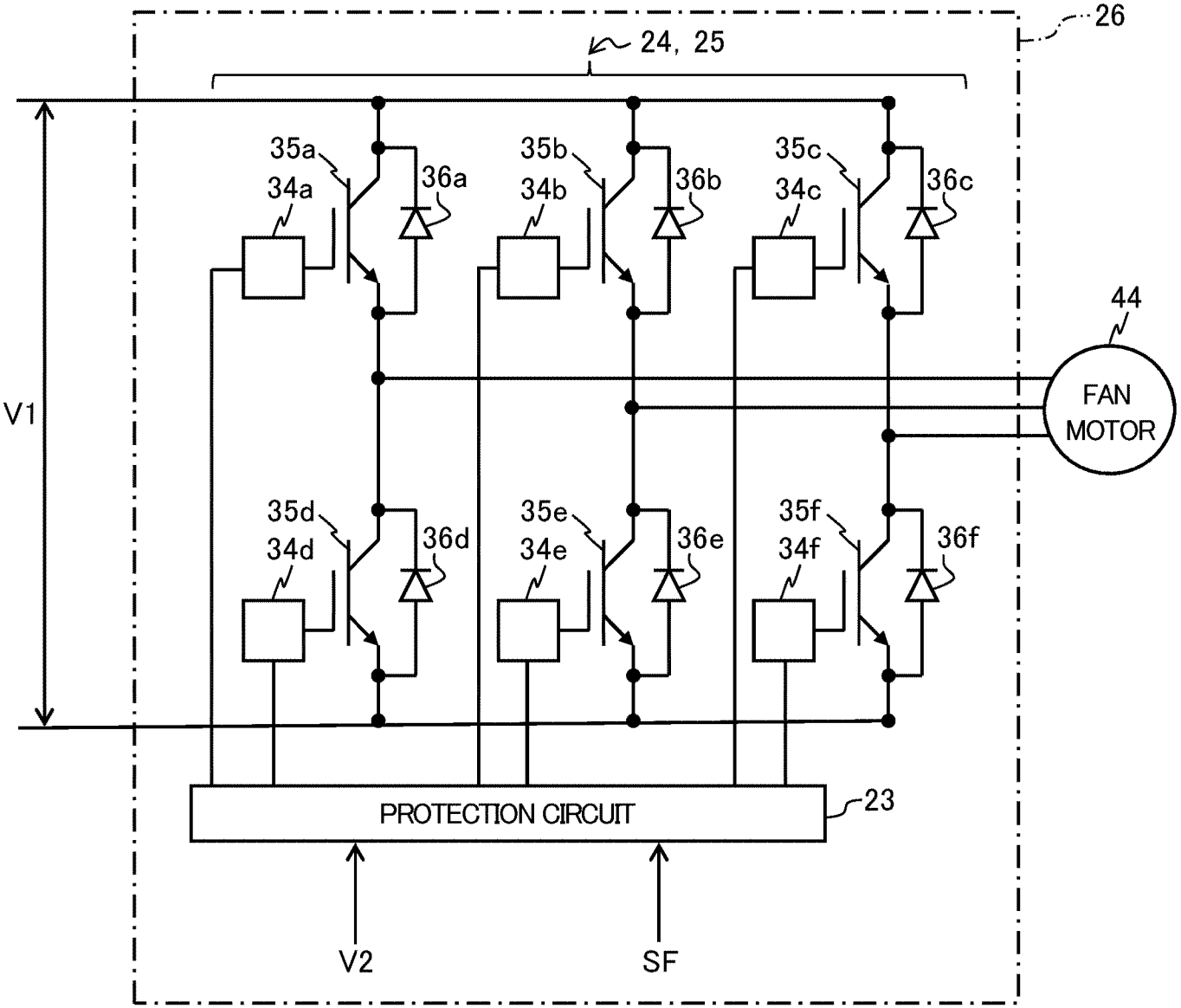
FIG. 5 is a circuit diagram of a fan driver board of the outdoor unit.

FIG. 5 is a circuit diagram of the fan driver board 26. In FIG. 5, the fan inverter circuit 25 has six bridge-connected IGBTs 35*a* to 35*f* and free-wheeling diodes 36*a* to 36*f* connected thereto in parallel. The fan driver circuit 24 has voltage amplifiers 34*a* to 34*f* respectively connected to gate terminals of the IGBTs 35*a* to 35*f*.

A PWM signal SF fed to the fan driver circuit 24 from the control circuit 9 (see FIG. 3) passes through the fan protection circuit 23 as shown in the figure. With this structure, if the control circuit 9 malfunctions to output an improper PWM signal SF, the fan protection circuit 23 blocks the PWM signal SF to protect the fan inverter circuit 25. It should be noted that the fan driver board 26 does not include those corresponding to the control circuit 9 and the power source circuits 11 and 12 in the compressor driver board 22. Reasons for this will be described below.

In the present embodiment, the control circuit 9 included in the compressor driver board 22 also outputs the PWM signal SF for the fan to the fan inverter circuit 25. For this reason, the fan driver board 26 does not include a control circuit of the same kind. The DC voltage V3 (5 V) provided by the power source circuit 12 is used as the power source voltage of the control circuit 9. As the fan driver board 26 does not include a control circuit, the DC voltage V3 needs not be supplied to the fan driver board 26. The DC voltage V2 (15 V) for driving the fan protection circuit 23 and the fan driver circuit 24 in the fan driver board 26 is supplied to the fan driver board 26 from the power source circuit 11 of the compressor driver board 22. Therefore, the fan driver board 26 does not include a power source circuit of the same kind.

As understood from the above description, the configuration of the present embodiment necessitates only one instance of each of the control circuit 9, the power source circuit 11, and the power source circuit 12. Thus, in particular, the fan driver board 26 for the propeller fan 43 can be reduced in area hence reducing cost.

When implementing one instance of each of the control circuit 9, the power source circuit 11, and the power source circuit 12, it is conceivable to implement them on a board other than the compressor driver board 22. For example, these circuits 9, 11, 12 may be implemented on the fan driver board 26, a board on which the noise filter 20 is mounted, a board on which the smoothing capacitor 3 is mounted, or the like. However, these circuits 9, 11, 12 are preferably implemented on the compressor driver board 22 like the present embodiment. The reason for this is described below.

Comparing the output power of the compressor inverter circuit 30 (power consumption of the compressor 46) with the output power of the fan inverter circuit 25 (power consumption of the propeller fan 27), the former is 5 to 20 times larger than the latter. Therefore, in the compressor inverter circuit 30, the amplitude of noise components superimposed on the supplied DC voltage V1 and noise components superimposed on the AC voltage supplied to the compressor 46 is relatively large.

The DC voltage V1 is supplied to the compressor driver board 22 via power cables to be inputted to the compressor inverter circuit 30. The AC voltage generated by the compressor inverter circuit 30 is outputted from the compressor driver board 22 via power cables. Signal cables and power cables and the like connected to the compressor driver board 22 are bundled to make up a harness. In this structure, power cables in the harness may possibly become a noise source, which superimposes noises on the signals being transmitted in the signal cables.

If the circuits 9, 11, and 12 are implemented on a board other than the compressor driver board 22 (e.g., fan driver board 26), control signals (e.g., PWM signal SC) fed from the control circuit 9 to the compressor driver circuit 4 pass through the harness, and thus are likely to have noise superimposed, increasing risk of malfunction of the control circuit 9. In addition, the DC voltages V2 and V3 provided by the power source circuits 11 and 12 are also likely to have noise superimposed, which increases the risk of malfunction of the control circuit 9 and/or compressor protection circuit 8.

In contrast, according to the present embodiment, the circuits 9, 11, and 12 are implemented on the compressor driver board 22. Thus, the control signals fed from the control circuit 9 to the compressor protection circuit 8 does not pass through a harness, and the DC voltages V2 and V3 supplied from the power source circuits 11 and 12 to the control circuit 9, the compressor protection circuit 8, and the compressor driver circuit 4 are not provided via a harness. This structure inhibits noise from being superimposed on control signals, and, as to the driving of the compressor 46, reduces the possibility of malfunction of the control circuit 9 and/or the compressor protection circuit 8 or the like.

Appearance Configuration of Electric Parts Box 45

Figure 6:
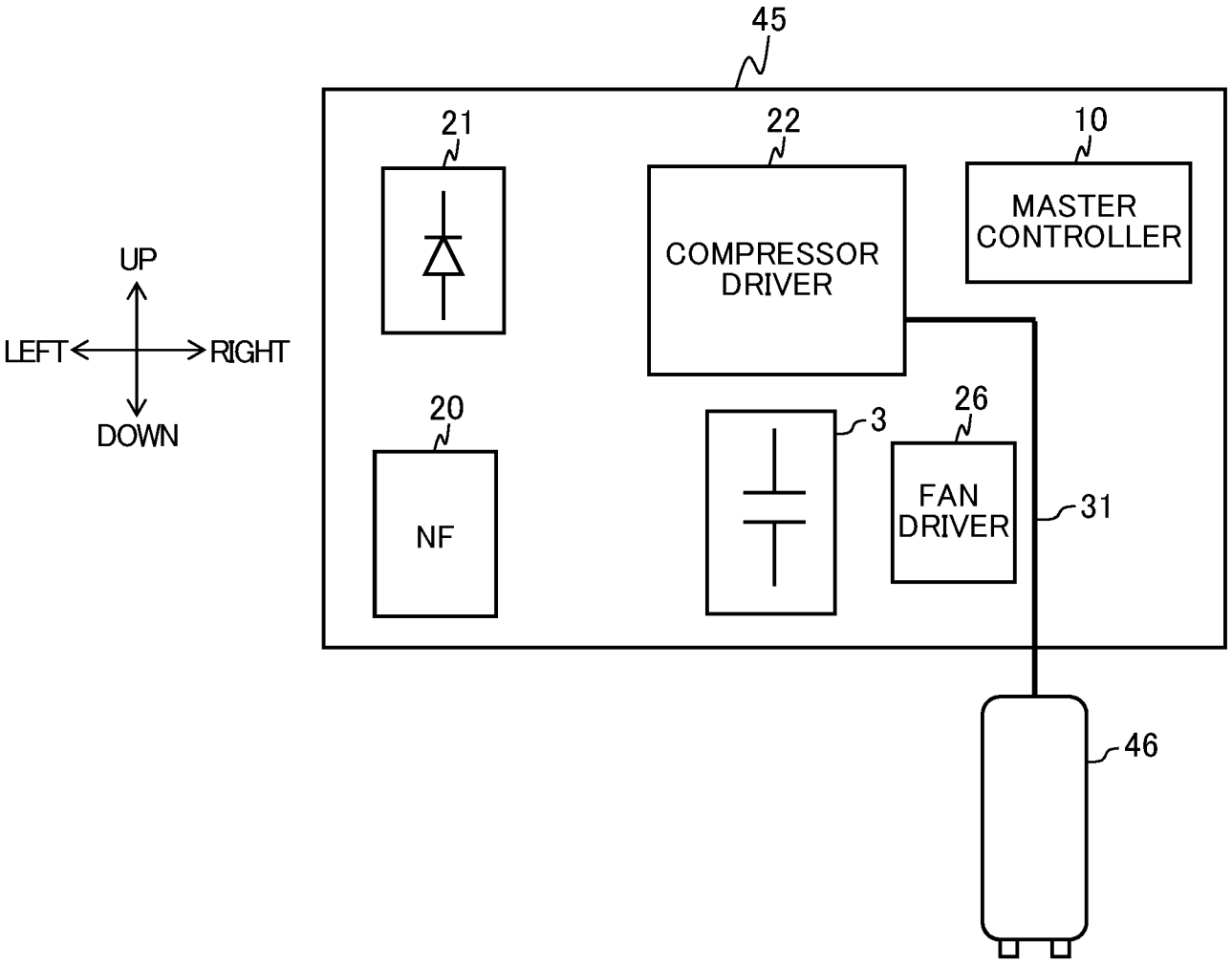
FIG. 6 is a front view of an electric parts box of the outdoor unit.

FIG. 6 is a front view of the electric parts box 45 according to the present embodiment. As shown in FIG. 6, arranged on a left portion of the electric parts box 45 are the diode bridge 21 and the noise filter 20, and arranged on an upper right portion of the electric parts box 45 is the master controller 10. The smoothing capacitor 3 is arranged on a lower center portion of the electric parts box 45. The compressor driver board 22 is arranged on the upper side of the smoothing capacitor 3. The fan driver board 26 is arranged on the right side of the smoothing capacitor 3. A harness 31 extends from the compressor driver board 22 to the right, extends such as to avoid crossing front surfaces of parts such as the master controller 10 and the fan driver board 26, and then is connected to the compressor 46. Arranging the harness 31 such as to avoid crossing the front surfaces of parts such as the master controller 10 and the fan driver board 26 (i.e., such as to avoid being opposed to the fan driver board 26 or the like in a thickness direction thereof) reduces influences of the noises coming from the harness 31.

One of the features of the present embodiment is that the compressor driver board 22 and the fan driver board 26 are arranged such as to surround the smoothing capacitor 3. Due to adoption of this arrangement, the smoothing capacitor 3 is close to the compressor driver board 22, and the smoothing capacitor 3 is also close to the fan driver board 26. Thus, this arrangement can reduce voltage fluctuations due to the switching of the IGBTs 5*a* to 5*f* in the compressor driver board 22 and reduce voltage fluctuations due to the switching of the IGBTs mounted on the fan driver board 26, reducing risk of malfunction of the control circuit 9. The reduction of voltage fluctuations improves the accuracy of detecting voltage or current by the compressor inverter circuit 30 in the compressor driver board 22.

As understood from the above, the present embodiment allows for: reduction of frequency of malfunctions of the control circuit 9; high-accuracy detection of the voltage or current by the compressor inverter circuit 30; reduction in the number of implementations of the control circuit 9 and power source circuits 11 and 12; and reduction of the area and the cost of the fan driver board 26.

Second Embodiment

Figure 7:
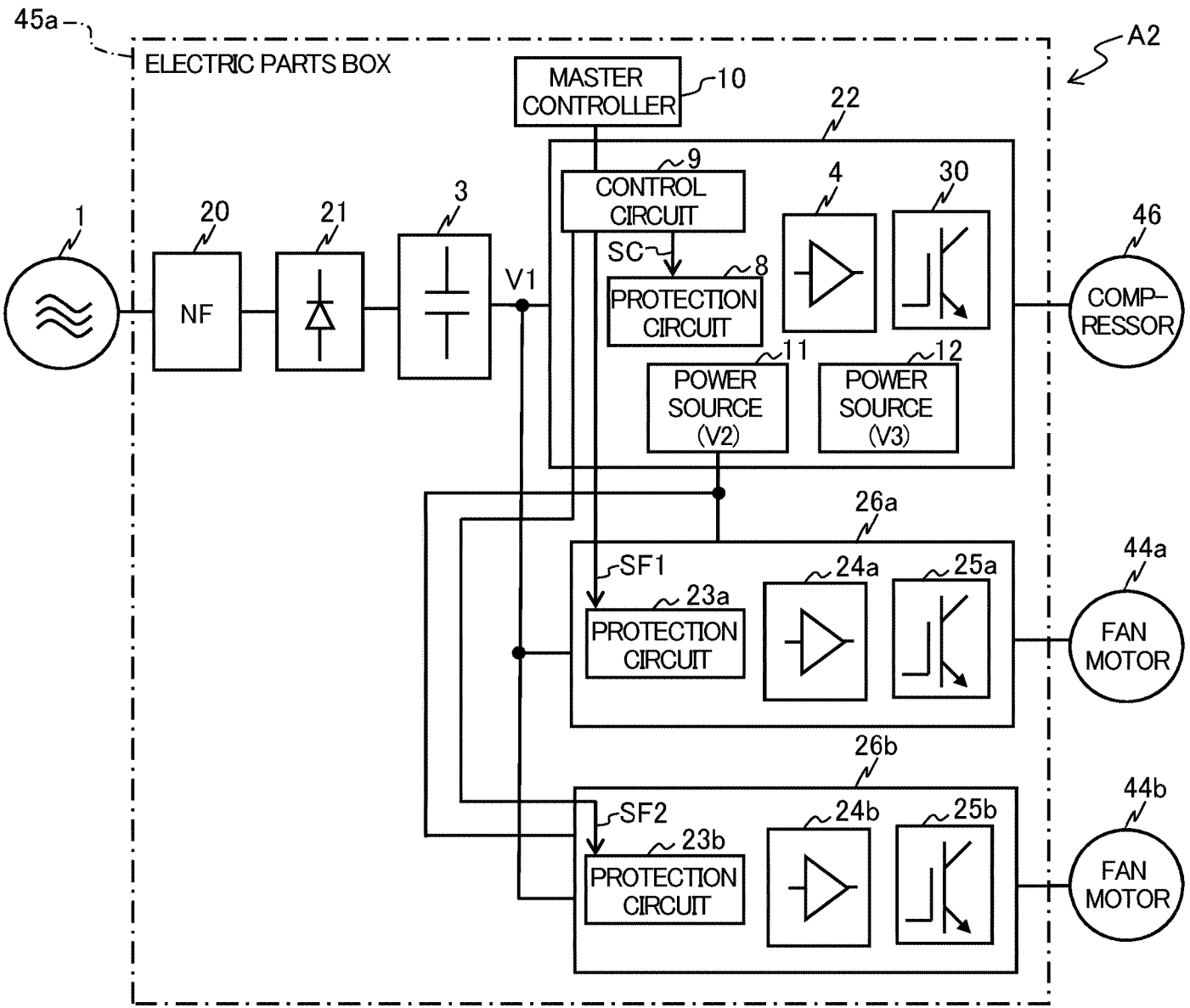
FIG. 7 is a block diagram of an outdoor unit for an air conditioner according to a second embodiment.

Next, with reference to the block diagram shown in FIG. 7, a description will be given of an outdoor unit A2 of an air conditioner according to a second embodiment of the present invention.

The outdoor unit A2 of the present embodiment is provided with two propeller fans (not shown) and is provided with two fan motors 44*a* and 44*b* in place of the one fan motor 44 in the first embodiment. An electric parts box 45*a* of the present embodiment includes two fan driver boards 26*a* and 26*b* respectively corresponding to the fan motors 44*a* and 44*b*. The fan driver boards 26*a* and 26*b* are each structured similarly to the fan driver board 26 (see FIG. 3) in the first embodiment. That is, the fan driver board 26*a* has a fan protection circuit 23*a*, a fan driver circuit 24*a*, and a fan inverter circuit 25*a*; and the fan driver board 26*b* has a fan protection circuit 23*b*, a fan driver circuit 24*b*, and a fan inverter circuit 25*b*.

The compressor driver board 22 is structured similarly to that in the first embodiment, except that the control circuit 9 in the present embodiment sends/receives a plurality of control signals (PWM signals SF1 and SF2 for fans, and the like) to/from the two fan driver boards 26*a* and 26*b*, respectively and correspondingly. The power source circuit 11 supplies the DC voltage V2 (15 V) to the two fan driver boards 26*a* and 26*b*. The electrical configurations of the outdoor unit A2 other than those described above are the same as those of the outdoor unit A1 of the first embodiment.

Figure 8:
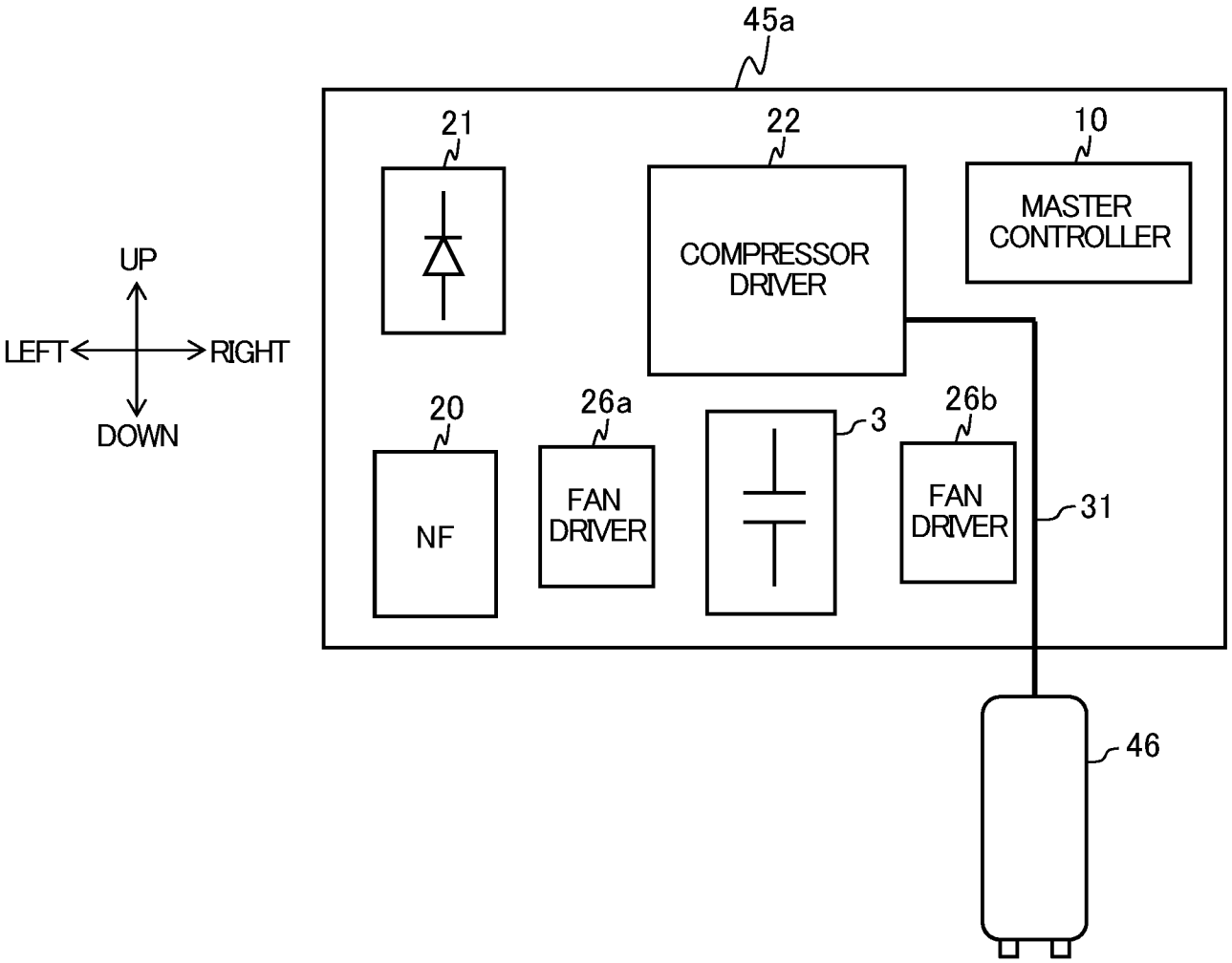
FIG. 8 is a front view of an electric parts box of the outdoor unit.

FIG. 8 is a front view of an electric parts box 45*a* in the present embodiment.

In the present embodiment, the two fan driver boards 26*a* and 26*b* are arranged on the left and right sides of the smoothing capacitor 3. That is, the compressor driver board 22 and fan driver boards 26*a* and 26*b* are arranged such as to surround the smoothing capacitor 3. With this structure, the smoothing capacitor 3 is close to the compressor driver board 22, and the smoothing capacitor 3 is also close to the fan driver boards 26*a* and 26*b*. Thus, similarly to the outdoor unit A1 of the first embodiment, the structure can reduce voltage fluctuations due to the switching of the IGBTs 5*a* to 5*f* in the compressor driver board 22 and reduce voltage fluctuations due to the switching of the IGBTs mounted on the fan driver boards 26*a* and 26*b*, reducing the risk of malfunction of the control circuit 9. The reduction of voltage fluctuations improves the accuracy of detecting voltage or current by the compressor inverter circuit 30 in the compressor driver board 22.

As understood from the above, the present embodiment allows for, similarly to the first embodiment: reduction of frequency of malfunctions of the control circuit 9; and high-accuracy detection of the voltage or current by the compressor inverter circuit 30. The present embodiment further allows for reduction in the number of implementations of the control circuit 9 and power source circuits 11 and 12, and thus allows for reducing the area and the cost of the fan driver boards 26*a* and 26*b* for the fan motors 44*a* and 44*b*.

Third Embodiment

Figure 9:
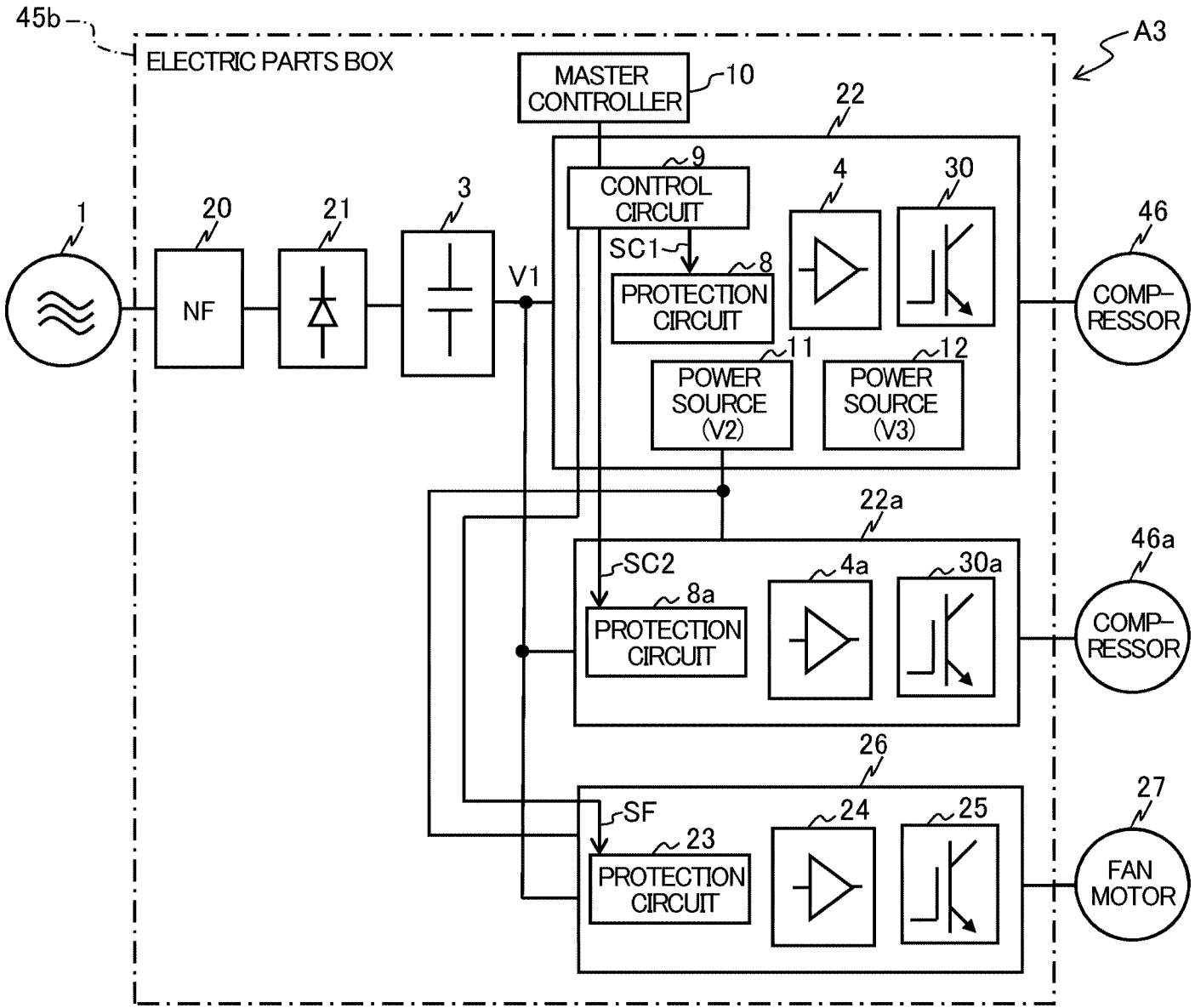
FIG. 9 is a block diagram of an outdoor unit for an air conditioner according to a third embodiment.

Next, with reference to the block diagram shown in FIG. 9, a description will be given of an outdoor unit A3 of an air conditioner according to a third embodiment of the present invention.

The outdoor unit A3 of the present embodiment has a compressor 46*a* in addition to the one compressor 46 in the first embodiment. An electric parts box 45*b* is provided with a compressor driver board 22*a* for driving the compressor 46*a*. The compressor driver board 22*a* has a compressor protection circuit 8*a*, a compressor driver circuit 4*a*, and a compressor inverter circuit 30*a* having the same configurations as those of the compressor protection circuit 8, the compressor driver circuit 4, and the compressor inverter circuit 30 in the compressor driver board 22.

The compressor driver board 22 is structured similarly to that in the first embodiment, except that the control circuit 9 in the present embodiment sends PWM signals SC1 and SC2 for the compressors to the protection circuits 8 and 8*a*, respectively and correspondingly. In addition, the control circuit 9 sends the PWM signal SF for the fan to the fan protection circuit 23 in the fan driver board 26. The power source circuit 11 supplies the DC voltage V2 (15 V) to both the compressor driver board 22*a* and the fan driver board 26. The electrical configurations of the outdoor unit A3 other than those described above are the same as those of the outdoor unit A1 of the first embodiment.

According to the present embodiment, the control circuit 9 controls the two compressors 46 and 46*a* and the one propeller fan 43. The one power source circuit 11 and the one power source circuit 12 supply the DC voltages V2 and V3 to parts of the compressor driver boards 22 and 22*a* and the fan driver board 26. This structure allows for reduction in the number of implementations of the control circuit 9 and power source circuits 11 and 12, and thus allows for reducing the area and the cost of the compressor driver board 22*a* and the fan driver board 26.

Fourth Embodiment

Figure 10:
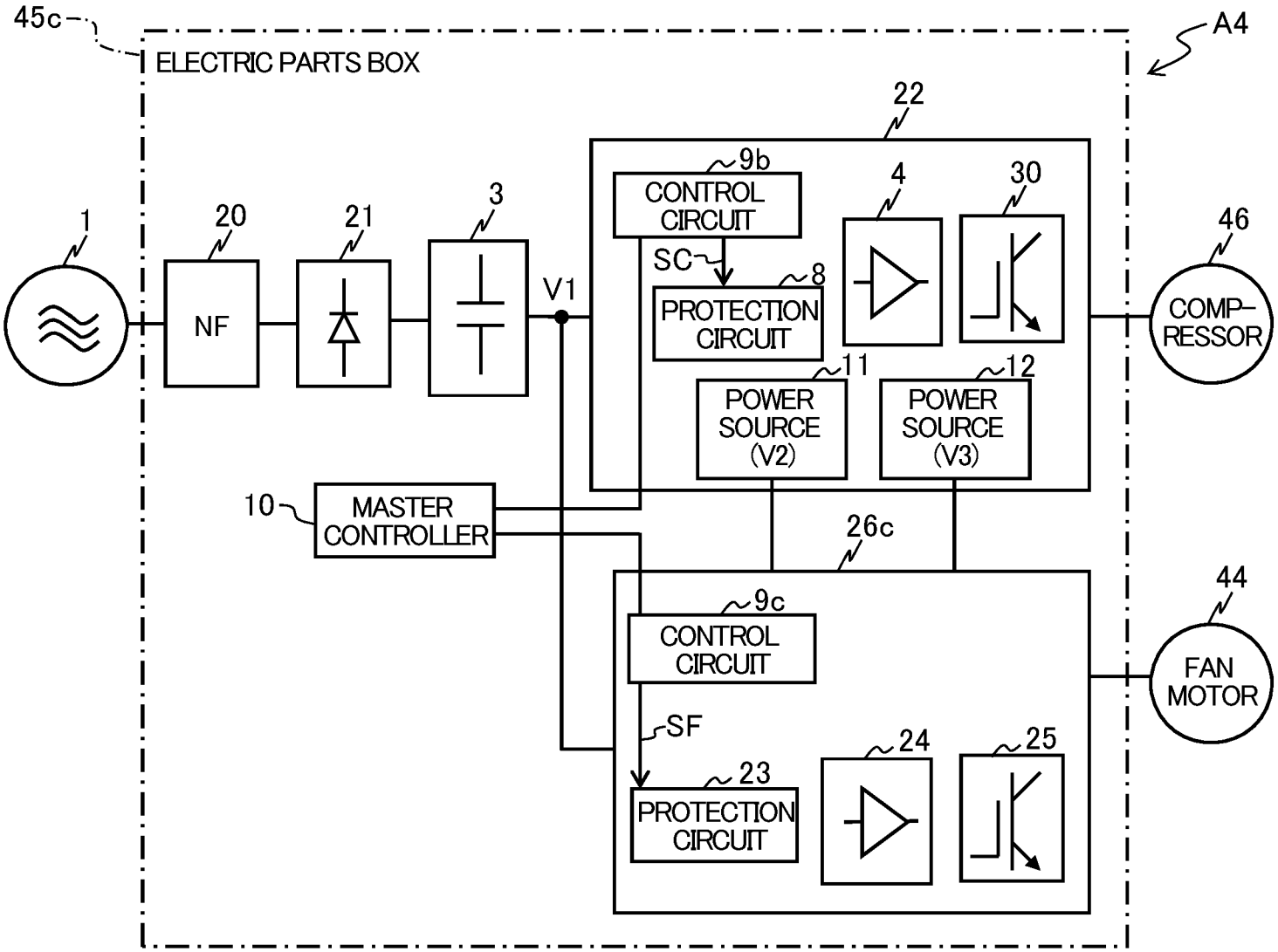
FIG. 10 is a block diagram of an outdoor unit for an air conditioner according to a fourth embodiment.

Next, with reference to the block diagram shown in FIG. 10, a description will be given of an outdoor unit A4 of an air conditioner according to a fourth embodiment of the present invention.

An electric parts box 45*c* in the outdoor unit A4 of the present embodiment has a fan driver board 26*c* shown in the figure in place of the fan driver board 26 (see FIG. 3) in the first embodiment. The fan driver board 26*c* differs from the fan driver board 26 of the first embodiment in that the fan driver board 26*c* independently has a fan controller circuit 9*c*. The fan controller circuit 9*c* generates a PWM signal SF for a fan to drive the fan inverter circuit 25 via the fan protection circuit 23 and the fan driver circuit 24.

The compressor driver board 22 is structured similarly to that in the first embodiment, except that a compressor controller circuit 9*b* provided in the compressor driver board 22 does not send the PWM signal SF or the like to the fan driver board 26*c*. The power source circuit 12 supplies the DC voltage V3 (5 V) to the fan driver board 26*c* in order to make the fan controller circuit 9*c* or the like in the fan driver board 26*c* operate. The master controller 10 commands the compressor controller circuit 9*b* to control the rotation speed of the compressor 46 and commands the fan controller circuit 9*c* to control the rotation speed of the fan motor 44. The configurations of the outdoor unit A4 other than those described above are the same as those of the outdoor unit A1 of the first embodiment.

In the configuration of the first embodiment (FIG. 3), the one control circuit 9 sends/receives control signals (PWM signals SC and SF) for controlling the compressor 46 and the fan motor 44, in which case, when the control signals go through the harness 31 (see FIG. 6), noises may possibly be superimposed on the control signals. The present embodiment is preferably applied to such a case. Arranging the control circuits 9*b* and 9*c* respectively on the compressor driver board 22 and the fan driver board 26*c* inhibits noises from being superimposed on control signals. Even the present embodiment necessitates only one instance of each of the power source circuit 11 and the power source circuit 12. Thus, the fan driver board 26*c* can be reduced in area hence reducing cost.

Fifth Embodiment

Figure 11:
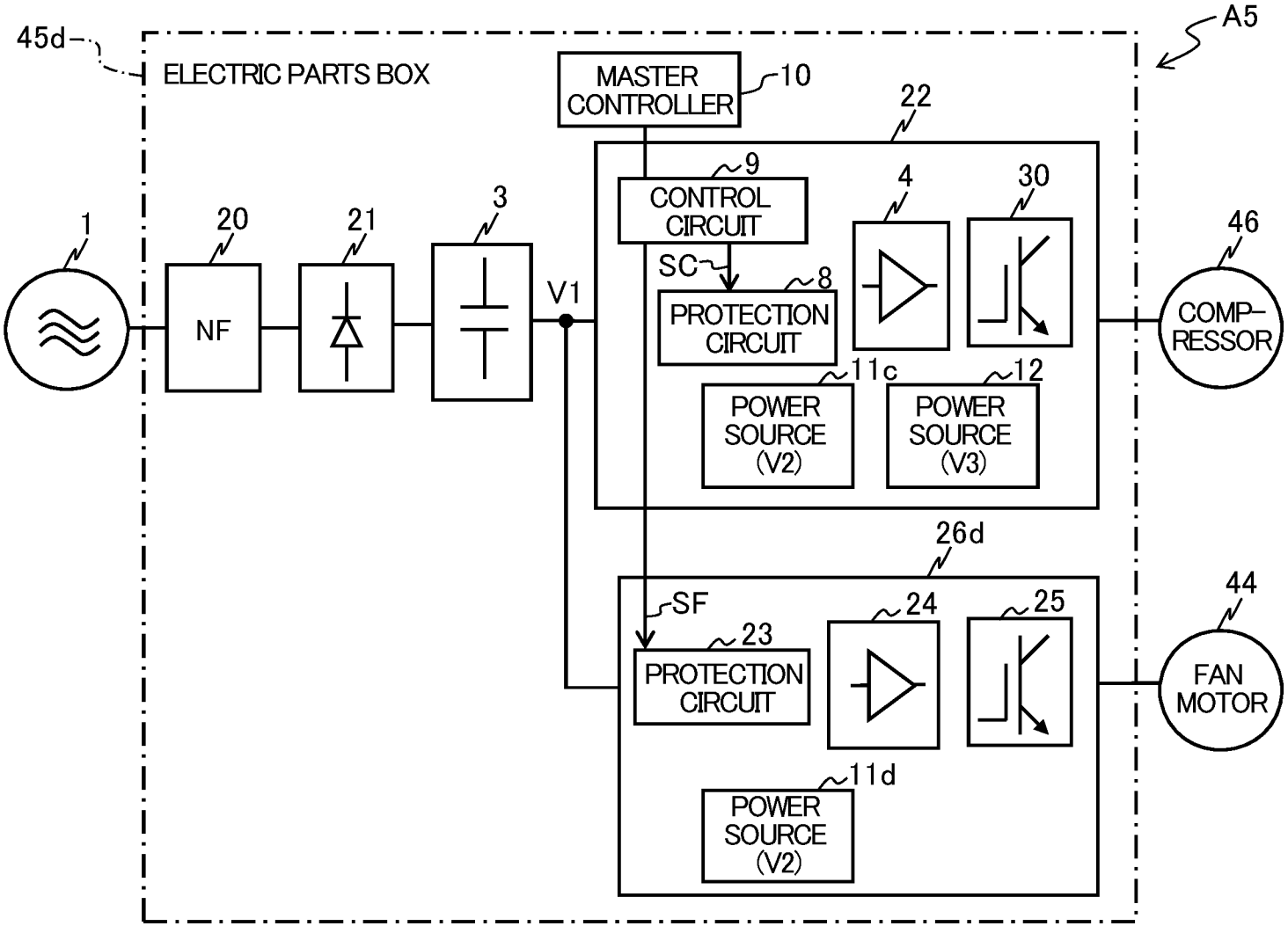
FIG. 11 is a block diagram of an outdoor unit for an air conditioner according to a fifth embodiment.

Next, with reference to the block diagram shown in FIG. 11, a description will be given of an outdoor unit A5 of an air conditioner according to a fifth embodiment of the present invention.

An electric parts box 45*d* in the outdoor unit A5 of the present embodiment has a fan driver board 26*d* shown in the figure in place of the fan driver board 26 (see FIG. 3) in the first embodiment. The fan driver board 26*d* differs from the fan driver board 26 of the first embodiment in that the fan driver board 26*d* has a fan power source circuit 11*d* that outputs the DC voltage V2 (15 V). The fan power source circuit 11*d* supplies the DC voltage V2 to the fan protection circuit 23 and the fan driver circuit 24 and the like in the fan driver board 26*d*. A compressor power source circuit 11*c* provided in the compressor driver board 22 supplies the DC voltage V2 to the protection circuit 8 and the compressor driver circuit 4 in the compressor driver board 22, but does not supply the DC voltage V2 to the fan driver board 26*d*. The configurations of the outdoor unit A5 other than those described above are the same as those of the outdoor unit A1 of the first embodiment.

In the configuration of the first embodiment (FIG. 3), the one power source circuit 11 supplies the DC voltage V2 to parts of the compressor driver board 22 and the fan driver board 26, in which case, when the DC voltage V2 is supplied through the harness 31 (see FIG. 6), noises may possibly be superimposed on the DC voltage V2. The present embodiment is preferably applied to such a case. Arranging the power source circuits 11*c* and 11*d* respectively on the compressor driver board 22 and the fan driver board 26*d* inhibits noises from being superimposed on each DC voltage V2. Even the present embodiment necessitates only one instance of each of the control circuit 9 and the power source circuit 12 that outputs the DC voltage V3 (5 V). Thus, the fan driver board 26*d* can be reduced in area hence reducing cost.

Modifications

The present invention is not limited to the above-described embodiments, and various modifications are possible. The above-described embodiments are exemplified to describe the present invention in an easily understandable manner, and the present invention is not limited to those including all of the described components. In addition, a part of the configuration of a certain embodiment may be replaced with a part of the configuration of another embodiment, and the configuration of a certain embodiment may be added with a configuration of another embodiment. Further, a part of the configuration in each of the embodiments may be deleted, added or replaced with other configuration. Examples of possible modifications of the above-described embodiments include the following.

(1) In each of the above embodiments, descriptions have been given of examples in which IGBTs 5*a* to 5*f* and 35*a* to 35*f* are used as switching elements. However, the switching elements may be other elements other than IGBTs, such as metal-oxide-semiconductor field-effect transistors (MOSFETs). The switching signals for controlling the switching elements may be ones other than PWM signals, such as pulse frequency modulation (PFM) signals.

(2) In each of the above embodiments, the harness 31 is disposed such as to avoid crossing front surfaces of the master controller 10 and the fan driver board 26 and the like (see FIGS. 6 and 8). However, if influences of the noise coming from the harness 31 are small, the harness 31 may be disposed such as to cross the front surfaces or vicinities of the various kinds of boards.

(3) In the electric parts box 45*a* (see FIG. 8) of the second embodiment, the fan driver boards 26*a* and 26*b* are disposed on the left and right sides of the smoothing capacitor 3, and the compressor driver board 22 is disposed on the upper side of the smoothing capacitor 3. However, either of the compressor driver board 22 and the fan driver boards 26*a* and 26*b* may be disposed on the lower side of the smoothing capacitor 3.

Summary of Configuration and Effects

As described above, the compressor driver board (22, 22*a*) in an outdoor unit (A1 to A5) of an air conditioner of each above-described embodiment further has at least either:

the shared control circuit (9) that feeds the single or plurality of first switching signals (SC, SC1, SC2) for compressor(s) to the compressor driver circuit(s) (4, 4*a*) and feeds the single or plurality of second switching signals (SF, SF1, SF2) for fan(s) to the fan driver circuit(s) (24, 24*a*, 24*b*); or the shared power source circuit (11) that steps down the first DC voltage (V1) to the second DC voltage (V2), and supplies the second DC voltage to the compressor driver circuit(s) (4, 4*a*) and the fan driver circuit(s) (24, 24*a*, 24*b*).

With this configuration, the fan driver board(s) (26, 26*a* to 26*d*) needs not have a part having the function of at least one of the shared control circuit (9) and the shared power source circuit (11), allowing for reducing the area and the cost of the fan driver board(s) (26, 26*a* to 26*d*) and thus allowing the outdoor unit (A1 to A5) of the air conditioner to be configured at low cost.

The compressor driver board (22) in the outdoor unit (A1) of the air conditioner of the first embodiment has both the shared control circuit (9) and the shared power source circuit (11). This structure allows for further reducing the area and the cost of the fan driver board (26).

The outdoor unit (A1) of the air conditioner of the first embodiment further has: the rectifier circuit (21) that rectifies an AC voltage inputted; and the smoothing capacitor (3) that smoothes a voltage outputted from the rectifier circuit (21) and provides the result of the smoothing as the first DC voltage (V1). The compressor driver board (22) and the fan driver board (26) are disposed adjacent to the smoothing capacitor (3) such as to surround the smoothing capacitor (3).

This structure shortens wiring distances between the smoothing capacitor (3), the compressor driver board (22), and the fan driver board (26), thus reduces voltage fluctuations at those parts and thus reduces risk of malfunction, as well as allows for configuring the outdoor unit (A1) of the air conditioner at low cost.

The outdoor unit (A1) of the air conditioner of the first embodiment further has the harness (31) that includes a bundled plurality of cables and connects the compressor (46) with the compressor driver board (22). The harness (31) is arranged such as to avoid being opposed to the compressor driver board (22) and the fan driver board (26) in a thickness direction thereof.

With this structure, noises generated from the harness (31) are less likely to propagate to the compressor driver board (22) and the fan driver board (26), which reduces risk of malfunction as well as enables configuring the outdoor unit (A1) of the air conditioner at low cost.

The outdoor unit (A2) of the air conditioner of the second embodiment has the plurality of fan motors (44*a*, 44*b*) respectively corresponding to a plurality of fans (43), and the plurality of the fan driver boards (26*a*, 26*b*) respectively corresponding to the plurality of fans (43). The plurality of the fan driver circuits (24*a*, 24*b*) are provided in the outdoor unit (A2). The shared control circuit (9) feeds the plurality of second switching signals (SF1, SF2) respectively and correspondingly to the plurality of the fan driver circuits (24*a*, 24*b*). The shared power source circuit (11) supplies the second DC voltage (V2) to the compressor driver circuit (4) and the plurality of the fan driver circuits (24*a*, 24*b*).

With this configuration, the fan driver boards (26*a*, 26*b*) need not have a control circuit and a power source circuit, allowing for reducing the area and the cost of the fan driver boards (26*a*, 26*b*).

The outdoor unit (A3) of the third embodiment has the plurality of compressors (46, 46*a*) and the plurality of the compressor driver boards (22, 22*a*). The plurality of the compressor driver circuits (4, 4*a*) are provided in the outdoor unit (A3). The shared control circuit (9) is provided in one of the plurality of compressor driver boards (22) and feeds the plurality of first switching signals (SC1, SC2) respectively and correspondingly to the plurality of compressor driver circuits (4, 4*a*) as well as feeds the single second switching signal (SF) to the fan driver circuit (24). The shared power source circuit (11) supplies the second DC voltage (V2) to the plurality of compressor driver circuits (4, 4*a*) and the fan driver circuit (24).

With this structure, any other one (22*a*) of the plurality of the compressor driver boards and the fan driver board (26) needs not have a control circuit and a power source circuit, allowing for reducing the area and the cost of the any other one the plurality of compressor driver boards and the fan driver board (26).

REFERENCE SIGNS LIST

1 AC power source
2*a* to 2*f* diode
3 smoothing capacitor
4, 4*a* compressor driver circuit
5*a* to 5*f* IGBT (first switching element for compressor)
8, 8*a* protection circuit
9 control circuit (shared control circuit)
9*b* compressor controller circuit
9*c* fan controller circuit
11 power source circuit (shared power source circuit)
11*c* compressor power source circuit
11*d* fan power source circuit
21 diode bridge (rectifier circuit)
22, 22*a* compressor driver board
24, 24*a*, 24*b* fan driver circuit
25, 25*a*, 25*b* fan inverter circuit
26, 26*a* to 26*d* fan driver board
30, 30*a* compressor inverter circuit
31 harness
35*a* to 35*f* IGBT (second switching element for fan)
43 propeller fan (fan)
44, 44*a*, 44*b* fan motor
46, 46*a* compressor
48 heat exchanger
A1 to A5 outdoor unit for an air conditioner
SC, SC1, SC2 PWM signal (first switching signal for compressor)
SF, SF1, SF2 PWM signal (second switching signal for fan)
V1 DC voltage (first DC voltage)
V2 DC voltage (second DC voltage)

The invention claimed is:

1. An outdoor unit for an air conditioner, comprising:
(i) a compressor that compresses refrigerant;
(ii) a heat exchanger that transfers heat between the refrigerant and outdoor air;
(iii) a fan motor that drives a fan for blowing the outdoor air to the heat exchanger;
(iv) a compressor driver board comprising:
a compressor inverter circuit having a plurality of first switching elements for the compressor, the plurality of first switching elements being used for generating a first AC voltage from a first DC voltage to drive the compressor, and
a compressor driver circuit that amplifies a first switching signal for the compressor and feeds the amplified first switching signal to the plurality of first switching elements; and
(v) a fan driver board comprising:
a fan inverter circuit having a plurality of second switching elements for the fan, the plurality of second switching elements being used for generating a second AC voltage from the first DC voltage to drive the fan motor, and
a fan driver circuit that amplifies a second switching signal for the fan and feeds the amplified second switching signal to the second plurality of switching elements,
wherein the compressor driver board comprises a shared power source circuit that steps down the first DC voltage to a second DC voltage and supplies the second DC voltage to the compressor driver circuit and to the fan driver circuit.

2. The outdoor unit according to claim 1,
wherein the compressor driver board further comprises a shared control circuit that feeds the first switching signal to the compressor driver circuit and feeds the second switching signal to the fan driver circuit.

3. The outdoor unit according to claim 2, further comprising:
a rectifier circuit that rectifies a third AC voltage inputted; and
a smoothing capacitor that smoothes a voltage outputted from the rectifier circuit and provides the smoothed voltage as the first DC voltage,
wherein the compressor driver board and the fan driver board are disposed adjacent to the smoothing capacitor such as to surround the smoothing capacitor.

4. The outdoor unit according to claim 3, further comprising:
a harness that has a bundled plurality of cables and connects the compressor with the compressor driver board,
wherein the harness is arranged such as to avoid being opposed to the compressor driver board and the fan driver board in a thickness direction thereof.

5. The outdoor unit according to claim 1,
wherein the outdoor unit is provided with a plurality of fan motors, including the fan motor, that respectively drive a plurality of fans, including the fan, and a plurality of fan driver boards, including the fan driver board, the plurality of fan driver boards respectively corresponding to the plurality of fans,
wherein a plurality of fan driver circuits, including the fan driver circuit, are provided accordingly,
wherein the shared power source circuit supplies the second DC voltage to the compressor driver circuit and the plurality of fan driver circuits.

6. The outdoor unit according to claim 5,
wherein the compressor driver board further comprises a shared control circuit that feeds the first switching signal to the compressor driver board and feeds a plurality of second switching signals, including the second switching signal, respectively corresponding to the plurality of fan driver circuits.

7. The outdoor unit according to claim 1,
wherein the outdoor unit is provided with a plurality of compressors, including the compressor, and a plurality of compressor driver boards, including the compressor driver board,
wherein a plurality of compressor driver circuits, including the compressor driver circuit, are provided accordingly,
wherein the shared power source circuit supplies the second DC voltage to the plurality of compressor driver circuits and the fan driver circuit.

8. The outdoor unit according to claim 7,
wherein a shared control circuit is provided in one of the plurality of compressor driver boards, and
wherein the shared control circuit feeds a plurality of first switching signals, including the first switching signal, respectively corresponding to the plurality of compressor driver circuits and feeds the second switching signal to the fan driver circuit.

9. The outdoor unit according to claim 1, wherein the compressor driver board includes the shared power source circuit and a compressor controller circuit that feeds the first switching signal to the compressor driver circuit, and wherein the fan driver board includes a fan controller circuit that feeds the second switching signal to the fan driver circuit.

10. An outdoor unit, comprising:

(i) a compressor that compresses refrigerant;

(ii) a heat exchanger that transfers heat between the refrigerant and outdoor air;

(iii) a fan motor that drives a fan for blowing the outdoor air to the heat exchanger;

(iv) a compressor driver board comprising:

a compressor inverter circuit having a plurality of first switching elements for the compressor, the plurality of first switching elements being used for generating a first AC voltage from a first DC voltage to drive the compressor, and a compressor driver circuit that amplifies a first switching signal for the compressor and feeds the amplified first switching signal to the plurality of first switching elements; and (v) a fan driver board comprising:

a fan inverter circuit having a plurality of second switching elements for the fan, the plurality of second switching elements being used for generating a second AC voltage from the first DC voltage to drive the fan motor, and a fan driver circuit that amplifies a second switching signal for the fan and feeds the amplified second switching signal to the second plurality of switching elements, wherein the compressor driver board comprises: a shared control circuit that feeds the first switching signal to the compressor driver circuit and feeds the second switching signal to the fan driver circuit, and a compressor power source circuit that steps down the first DC voltage to a second DC voltage and supplies the second DC voltage to the compressor driver circuit and to the fan driver circuit.

* * * * *